United States Patent [19]

Leonardi

[11] 4,191,509

[45] Mar. 4, 1980

[54] ROTOR BLADE ATTACHMENT

[75] Inventor: Salvatore A. Leonardi, Glastonbury, Conn.

[73] Assignee: United Technologies Corporation, Hartford, Conn.

[21] Appl. No.: 864,948

[22] Filed: Dec. 27, 1977

[51] Int. Cl.[2] ..... F01D 5/30

[52] U.S. Cl. ..... 416/219 R; 416/241 B

[58] Field of Search ..... 416/219 R, 219 A, 241 B

[56] References Cited

U.S. PATENT DOCUMENTS 2,429,215 10/1947 Boestad ..... 416/219 R

FOREIGN PATENT DOCUMENTS 950557 10/1956 Fed. Rep. of Germany ..... 416/219 R
677142 8/1952 United Kingdom ..... 416/219 R
234061 11/1969 U.S.S.R. ..... 416/219 R

*Primary Examiner*—Everette A. Powell, Jr.
*Attorney, Agent, or Firm*—Robert C. Walker

[57] ABSTRACT

A turbine wheel assembly having an improved blade attachment is disclosed. Techniques for increasing the low cycle fatigue life of the components forming the attachment are developed. In one specific embodiment a "fir tree" type attachment includes interlocking root teeth and disk teeth. Correspondingly, grooves accommodate the interlocking teeth. Each groove is contoured in a first region to a first radius and in a second region to a second radius.

3 Claims, 4 Drawing Figures

ROTOR BLADE ATTACHMENT

BACKGROUND OF THE INVENTION

1. Field of the Invention

This invention relates to rotary machines, and specifically to turbine wheel assemblies of a gas turbine engine.

2. Description of the Prior Art

Modern gas turbine engines comprise the principal class of rotary machines to which the present concepts apply. In a gas turbine engine working medium gases are compressed in a compression section of the engine and are flowed to a combustion section where fuel is mixed with the gases and burned to add energy to the flowing medium. The high energy medium is subsequently flowed to a turbine section where a portion of the energy is extracted and applied to drive the engine compressor.

The turbine includes a plurality alternating rows of rotor blades and stator vanes. Each row of stator vanes directs the working medium gases to a preferred angle of entry into the downstream row of rotor blades. The rotor blades in turn extract energy from the medium gases for driving the engine compressor. Each row of rotor blades is mounted around the periphery of a circular disk structure. The combination of rotor blades and supporting disk are known as a wheel assembly. During operation of a gas turbine engine, wheel rotation speeds in excess of seven thousand five hundred revolutions per minute (7500 rpm) are common.

Each blade of the wheel assembly has a root section which engages a correspondingly contoured attachment slot in the disk. Intricate root geometries have been devised to transfer centripetal restraining loads from the disk to each blade. One widely used geometry is aptly described as a "fir tree" attachment. Such an attachment is illustrated in FIG. 1, and the present invention is later described with respect thereto.

One factor limiting the life of rotor blades and disks is the low cycle fatigue life of the material from which the respective components are fabricated. Each cycle of operation loads the components to a given stress level. After repeated occurrence, each cycled component will ultimately develop fatigue cracks. At very low stress levels the number of cycles before cracks appear is nearly infinite. At high stress levels, the number of cycles is severely limited. The fatigue life of each part is referred to as its LCF life.

The present state of the attachment art as practiced in the most modern engines today is as described in the FIG. 3 (Prior Art) illustration of a portion of a "fir tree" type attachment. The teeth on the blade root extend to engage corresponding grooves in the disk attachment slot. Each groove in the disk is formed to a single radius. Similarly, the teeth in the disk slot extend to engage corresponding grooves in the blade root. Each groove in the root is formed of a single radius. The concepts of the present invention depart from those of the prior art illustration in the manner hereinafter disclosed.

SUMMARY OF THE INVENTION

A primary object of the present invention is to provide adequate low cycle fatigue life for turbine blade roots and their corresponding disk attachment slots. A collateral object is to minimize the depth of each root and its corresponding attachment slot. Reductions in the level of combined bending and shear stress is sought, and a specific goal is to enable increased filet radii in regions where both the bending loads and the shear loads place the periphery material in tension.

According to the present invention, the root section of rotor blade has a plurality of teeth which extend to engage corresponding grooves in the attachment slot of a supporting disk wherein each groove is contoured in a radially outward region to a first radius and in a radially inward region to a second radius, the first radius being larger than the second radius.

Similarly, the attachment slot of a rotor disk has a plurality of teeth which extend to engage corresponding grooves in root of a rotor blade wherein each groove is contoured in a radially inward region to a first radius and in a radially outward region to a second radius, the first radius being larger than the second radius.

A primary feature of the present invention is the compound contour of the disk grooves and of the corresponding rotor blade grooves. Each groove is contoured to a first radius and a second radius. The first radius is larger than the second radius and covers the contour region of the groove in which both bending loads and shear loads act in concert to place the blade material in severe tension. The second radius covers the contour region of the root in which bending loads and shear loads act in opposition.

A principal advantage of one embodiment of the present invention is improved low cycle fatigue life (LCF) at an equivalent root depth. Increasing the first radius and decreasing the second radius in accordance with the teaching herein, enables a reduction in maximum stress without a corresponding increase in root depth. In other embodiments, disk weight may be reduced without a corresponding reduction in low cycle fatigue life. Reducing the depth of the root decreases the amount of disk material above the live rim of the disk.

The foregoing, and other objects, features and advantages of the present invention will become more apparent in the light of the following detailed description of the preferred embodiment thereof as shown in the accompanying drawing.

DETAILED DESCRIPTION

Figure 1:
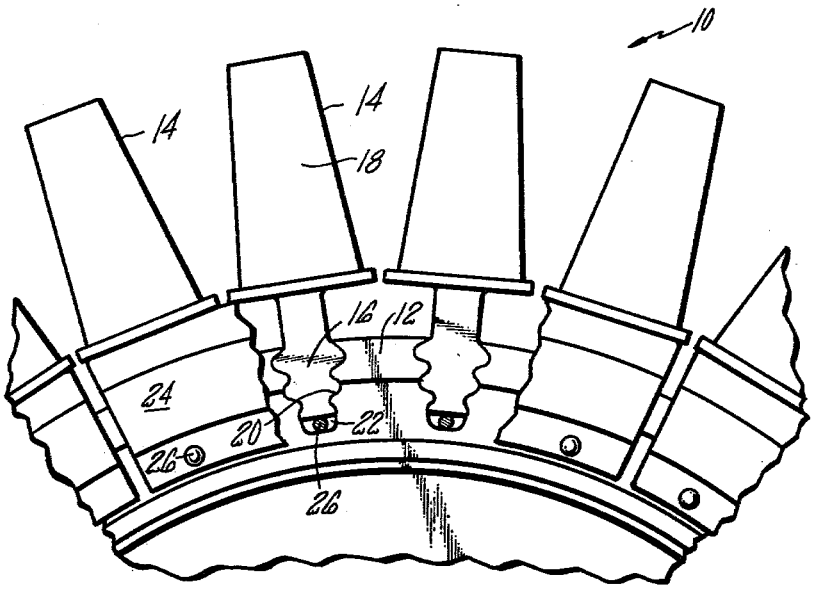
FIG. 1 is a simplified illustration of a portion of a rotor blade assembly.

A portion of a turbine wheel assembly 10 is illustrated in FIG. 1. The wheel assembly includes a rotor disk 12 and a plurality of rotor blades 14 extending radially outward therefrom. Each blade has a root section 16 and an airfoil section 18. Each root section is of the "fir tree" type. The root section of each blade engages a correspondingly shaped slot 20 at the periphery of the disk. Each disk slot extends below the root section of the blade to form a root cavity 22 between the blade and the disk. At least one sideplate 24 abuts the disk to trap the blades in the corresponding disk slots. A plurality of rivets 26 passing through corresponding root cavities secure each sideplate to the disk.

Figure 4:
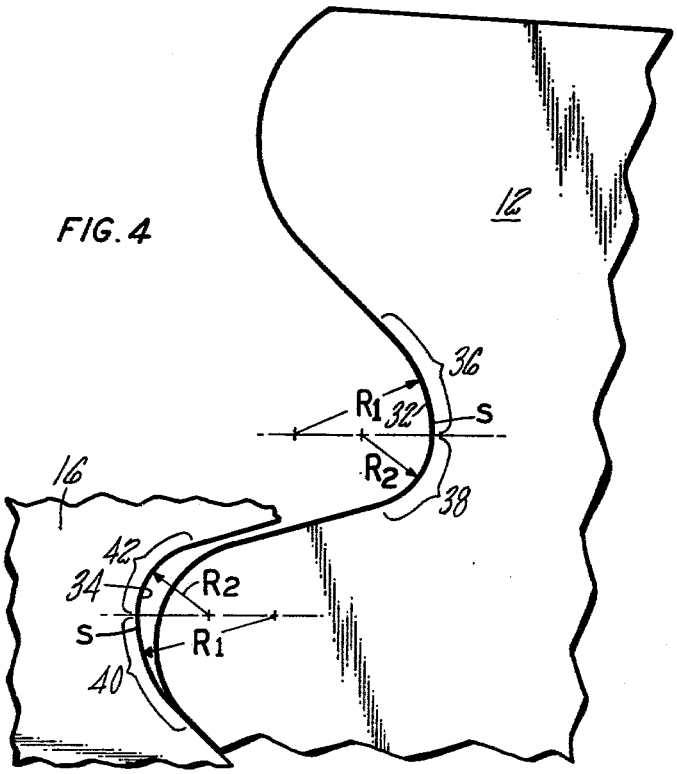
FIG. 4 is an enlarged illustration of a portion of the "fir tree" attachment showing the dual radii of curvature of the present invention.
Figure 2:
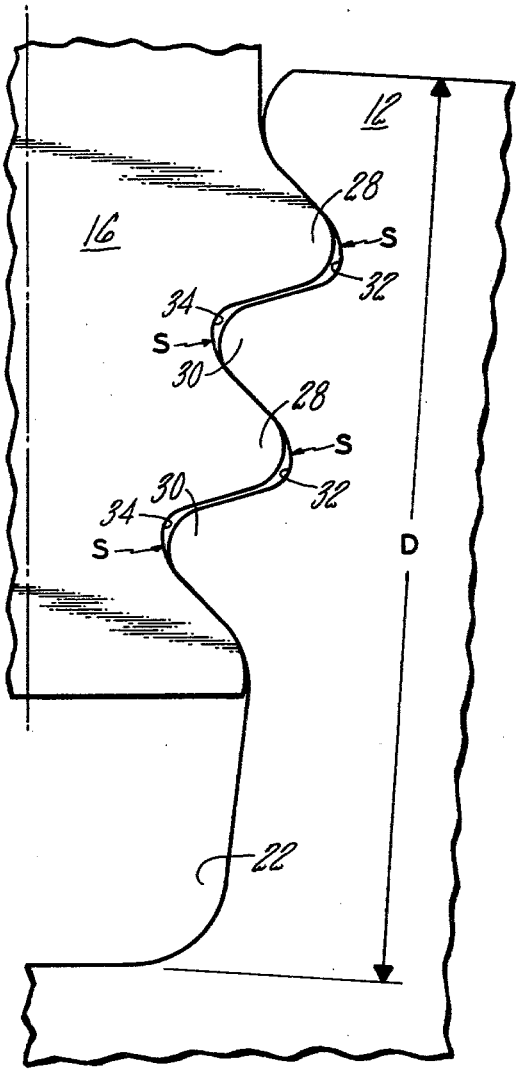
FIG. 2 is an enlarged view of a portion of the root attachment of a FIG. 1 blade contoured in accordance with the present invention.

The "fir tree" type attachment is shown in greater detail in FIGS. 2 and 4. The root section 16 of the blade has a plurality of teeth 28 which extend to engage the disk. The attachment slot of the disk similarly has a plurality of teeth 30 which extend to engage the root section of the blade. Accommodating each blade tooth is a corresponding groove 32 in the disk slot. Accommodating each disk tooth is a corresponding groove 34 in the blade. Each disk groove is contoured in an upper, or radially outward region 36 to a first radius $R_1$ and in a lower, or radially inward region 38 to a second radius $R_2$. Each blade groove is contoured in a lower, or radially inward region 40 to a first radius $R_1$ and in an upper, or radially outward region 42 to a second radius $R_2$. The radii $R_1$ are larger than the radii $R_2$. FIG. 4 illustrates the relationship of the radii $R_1$ and $R_2$ forming the contour of a disk groove and of a blade groove.

During rotation of the wheel assembly centrifugally generated forces urge the blades radially outward from the disk. Centripetal restraining forces are imparted by the disk, through the "fir tree" attachment to each blade. The teeth of the blade and of the disk are subjected to combined shear and bending stresses. In the upper regions 36 of the disk grooves 32 and in the lower regions 40 of the blade grooves 34, the shear and bending stresses are additive. In the lower regions 38 of the disk grooves and in the upper regions 42 of the blade grooves, the bending and shear stresses are opposing. Resultantly, maximum combined stresses occur in the regions 36 and 40, and more particularly near the locations S.

Figure 3:
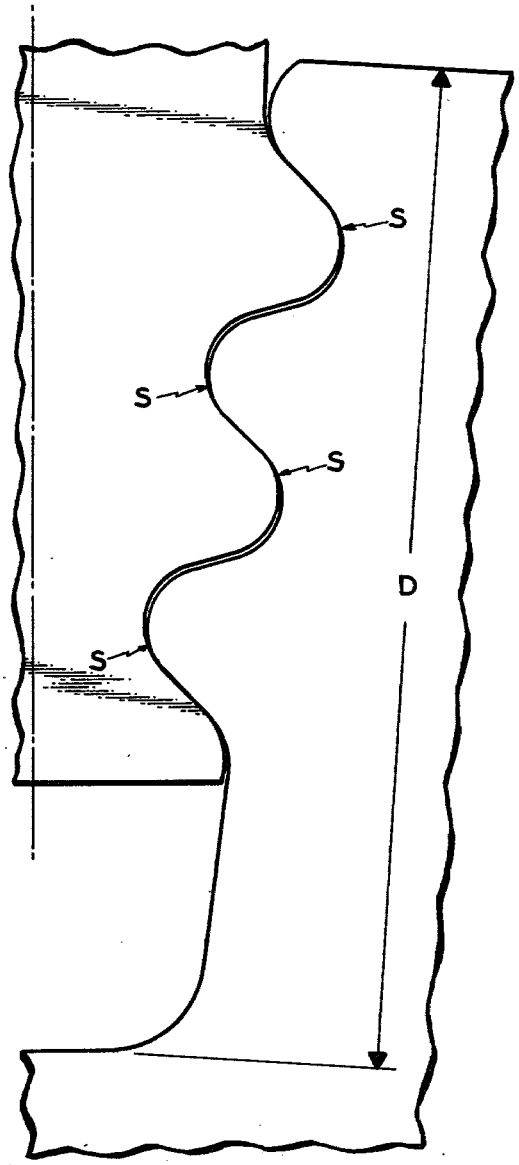
FIG. 3 PRIOR ART
FIG. 3 is a view, corresponding to FIG. 2, of a conventionally contoured root attachment of the Prior Art.

The "fir tree" attachment of the present invention is illustrated comparatively to a "fir tree" attachment of the prior art in FIGS. 2 and 3. Maximum stress at the periphery of the blade material and at the periphery of the disk material in the regions of highest concentration S are nearly equal. Illustrated, therefore, is an embodiment of the invention enabling a decreased root depth D. The decreased root depth is enabled through the use of the compound radii forming the disk grooves 32 and the blade grooves 34. The grooves are formed of the larger radii $R_1$ in the regions of high stress concentration S. The smaller radii $R_2$ are employed in the regions of lower stress concentration.

The amount of dead material above the live rim of the disk is directly proportional to the depth D of the root. Decreasing the root depth enables construction of a lower weight disk. Collaterally, decreasing the root depth enables increased blade loading into the disk in embodiments requiring a large number of blades on a relatively small diameter disk. The blades may be spaced more closely together while maintaining adequate material at the periphery of the disk.

In other embodiments, practice of the invention results in reduced maximum stresses at equivalent blade depths D. In such an embodiment, the radii $R_1$ are enlarged over those illustrated in FIG. 2 while the radii $R_2$ are held constant.

Although the invention has been shown and described with respect to preferred embodiments thereof, it should be understood by those skilled in the art that various changes and omissions in the form and detail thereof may be made therein without departing from the spirit and the scope of the invention.

Having thus described typical embodiments of my invention, that which I claim as new and desire to secure by Letters Patent of the United States is:

1. A rotor blade of the type having a root section including a plurality of grooves in the root section for engagement with a blade restraining member, wherein the improvement comprises:

a root section having grooves formed to a first radius of curvature in a lower region of each groove and formed to a second radius of curvature in an upper region of each groove, the first radius of curvature being larger than the second radius of curvature.

2. A rotor blade assembly of the type having a plurality of rotor blades extending radially outward from a rotor disk, wherein the improvement comprises:

a blade root having a plurality of teeth and a plurality of root grooves wherein each root groove is formed to a first radius of curvature in a radially inward region thereof and to a second radius of curvature in a radially outward region thereof, the first radius of curvature being larger than the second radius of curvature; and a rotor disk having a blade attachment slot at the periphery thereof including a plurality of teeth extending into engagement with corresponding grooves of said blade root and a plurality of disk grooves adapted to receive corresponding blade teeth wherein each disk groove is formed to a first radius of curvature in a radially outward region thereof and to a second radius of curvature in a radially inward region thereof, the first radius of curvature being larger than the second radius of curvature.

3. A rotor disk of the type having a rotor blade attachment slot including a plurality of grooves in the slot for engagement with the root section of a rotor blade, wherein the improvement comprises:

a disk including a blade attachment slot having grooves formed to a first radius of curvature in the radially outward region of each slot and to a second radius of curvature in the radially inward region of each slot, the first radius of curvature being larger than the second radius of curvature.

* * * * *